US009997303B2

(12) United States Patent
Galm et al.

(10) Patent No.: US 9,997,303 B2
(45) Date of Patent: Jun. 12, 2018

(54) CIRCUIT BREAKER TERMINAL COVER AND STRIP OF TERMINAL COVERS

(71) Applicant: LayerZero Power Systems, Inc., Aurora, OH (US)

(72) Inventors: James M. Galm, Chagrin Falls, OH (US); Mijo Dejanovic, Windham, OH (US); Milind Bhanoo, Chagrin Falls, OH (US); Steven Janko, Chagrin Falls, OH (US)

(73) Assignee: LayerZero Power Systems, Inc., Aurora, OH (US)

( * ) Notice: Subject to any disclaimer, the term of this patent is extended or adjusted under 35 U.S.C. 154(b) by 0 days. days.

(21) Appl. No.: 15/235,215

(22) Filed: Aug. 12, 2016

(65) Prior Publication Data

US 2017/0047175 A1 Feb. 16, 2017

Related U.S. Application Data

(60) Provisional application No. 62/204,665, filed on Aug. 13, 2015, provisional application No. 62/296,156, filed on Feb. 17, 2016.

(51) Int. Cl.
*H01H 9/02* (2006.01)
*H01H 71/08* (2006.01)

(52) U.S. Cl.
CPC ..... *H01H 9/0264* (2013.01); *H01H 71/08* (2013.01)

(58) Field of Classification Search
CPC ..... H01H 9/0264; H01H 9/047
USPC ..... 200/293, 306, 333
See application file for complete search history.

(56) References Cited

U.S. PATENT DOCUMENTS

| | | | | |
|---|---|---|---|---|
| D204,386 | S | 4/1966 | Davis | |
| 3,831,120 | A | 8/1974 | Powell | |
| D246,851 | S | 1/1978 | Tarchalski et al. | |
| D254,667 | S | 4/1980 | Sare | |
| 4,899,120 | A * | 2/1990 | Ohtake | H01H 9/0264 335/132 |
| D318,268 | S | 7/1991 | Oikawa et al. | |
| 5,194,018 | A * | 3/1993 | Lopata | H01R 13/514 29/884 |
| 5,241,289 | A | 8/1993 | Markowski et al. | |
| D354,272 | S | 1/1995 | Reed | |
| 5,677,655 | A * | 10/1997 | Hinata | H01H 50/545 335/132 |

(Continued)

OTHER PUBLICATIONS

Ex Parte Quayle Office Action from U.S. Appl. No. 29/517,517 dated May 27, 2016.

*Primary Examiner* — Gary Paumen
(74) *Attorney, Agent, or Firm* — Calfee, Halter & Griswold LLP

(57) ABSTRACT

An exemplary circuit breaker terminal cover includes a cover and at least one attachment portion. The cover has first and second side walls and a vented surface extending between the first and second side walls, the first and second side walls extending to form a wire opening. The at least one attachment portion is configured to hold the terminal cover in place and to removably engage at least one of an opening, a side, an edge, a protrusion, a fastener, a wire, and a handle. An exemplary strip of circuit breaker terminal covers includes a plurality of terminal covers and at least one frangible connection joining two adjacent terminal covers of the plurality of terminal covers.

31 Claims, 24 Drawing Sheets

(56) References Cited

U.S. PATENT DOCUMENTS

| | | | | |
|---|---|---|---|---|
| 5,704,815 | A * | 1/1998 | Shibata | H01H 9/0264 439/709 |
| 5,772,480 | A * | 6/1998 | Yamamoto | H01R 4/2433 29/857 |
| 5,811,749 | A * | 9/1998 | Bausch | H01H 9/342 200/306 |
| D411,984 | S | 7/1999 | Wu | |
| 6,087,609 | A | 7/2000 | Thilker et al. | |
| 6,089,914 | A * | 7/2000 | Piovesan | H01R 43/18 439/590 |
| 6,191,377 | B1 | 2/2001 | Roesner et al. | |
| 6,198,063 | B1 * | 3/2001 | Kramer | H01H 9/0264 200/306 |
| 6,762,389 | B1 | 7/2004 | Crooks et al. | |
| 7,170,020 | B2 * | 1/2007 | Kawata | H01H 9/0264 200/293 |
| 8,698,023 | B2 * | 4/2014 | Grunwald | H01H 9/0264 200/303 |
| 2003/0048586 | A1 | 3/2003 | Faber et al. | |
| 2003/0076204 | A1 | 4/2003 | Whipple et al. | |
| 2005/0109597 | A1 * | 5/2005 | Etscheidt | H01H 9/0264 200/293 |
| 2005/0164564 | A1 * | 7/2005 | Kawata | H01H 1/5855 439/793 |
| 2005/0280973 | A1 * | 12/2005 | Kawata | H01H 9/0264 361/115 |
| 2010/0081316 | A1 * | 4/2010 | Eppe | H01H 1/5844 439/441 |
| 2011/0176287 | A1 | 7/2011 | Coomer et al. | |
| 2011/0209972 | A1 * | 9/2011 | Eppe | H01H 71/08 200/293 |

* cited by examiner

CIRCUIT BREAKER TERMINAL COVER AND STRIP OF TERMINAL COVERS

CROSS-REFERENCE TO RELATED APPLICATIONS

This application claims priority to and the benefit of U.S. Provisional Patent Application Nos. 62/204,665, filed on Aug. 13, 2015, and 62/296,156, filed on Feb. 17, 2016, which are both incorporated herein by reference in their entirety.

TECHNICAL FIELD

The present invention relates generally to safety equipment for electrical system components, such as circuit breakers, and methods of using the same.

BACKGROUND OF THE INVENTION

Circuit breakers are known to those skilled in the art, e.g., ABB PROLINE brand circuit breakers. An exemplary ABB PROLINE brand circuit breaker is shown in FIG. 1A. ABB PROLINE circuit breakers have an opening 10 into which a screw driver is inserted to tighten wires (not shown) inside the circuit breaker. More specifically, stripped wires are inserted into an opening 12 in the circuit breaker and a screw driver is inserted into the opening 10 to tighten the wires to secure them in place.

Applicants have appreciated the need for an electrically insulated cover to prevent someone from accidentally touching the wires or any electrically activated portion of the breaker inside the opening 12.

SUMMARY

Exemplary embodiments of circuit breaker terminal covers and methods of using terminal covers are disclosed herein.

An exemplary circuit breaker terminal cover includes a cover and at least one attachment portion. The cover has first and second side walls and a vented surface extending between the first and second side walls, the first and second side walls extending to form a wire opening. The at least one attachment portion is configured to hold the terminal cover in place and to removably engage at least one of an opening, a side, an edge, a protrusion, a fastener, a wire, and a handle.

Another exemplary embodiment of the present disclosure relates to a method for using circuit breaker terminal covers. The method includes providing one or more terminal covers attached to one or more circuit breakers, removing at least one terminal cover from each circuit breaker to be connected, connecting at least one wire to a terminal connector of the circuit breaker to be connected, and attaching the terminal cover to the circuit breaker.

An exemplary strip of circuit breaker terminal covers includes a plurality of terminal covers and at least one frangible connection joining two adjacent terminal covers of the plurality of terminal covers.

Still another exemplary embodiment of the present disclosure relates to a method for using a strip of circuit breaker terminal covers. The method includes providing a first strip of terminal covers comprising; separating two adjacent terminal covers along the frangible connection to form a second strip of terminal covers that is shorter than the first strip of terminal covers; and attaching the second strip of terminal covers to a plurality of circuit breakers.

BRIEF DESCRIPTION OF THE DRAWINGS

These and other features and advantages of the present invention will become better understood with regard to the following description and accompanying drawings in which.

DETAILED DESCRIPTION

This Detailed Description merely describes exemplary embodiments of the invention and is not intended to limit the scope of the claims in any way. Indeed, the invention as claimed is broader than the exemplary embodiments, and the terms used in the claims have their full ordinary meaning, unless a limiting definition is expressly provided herein.

Figure 1A:
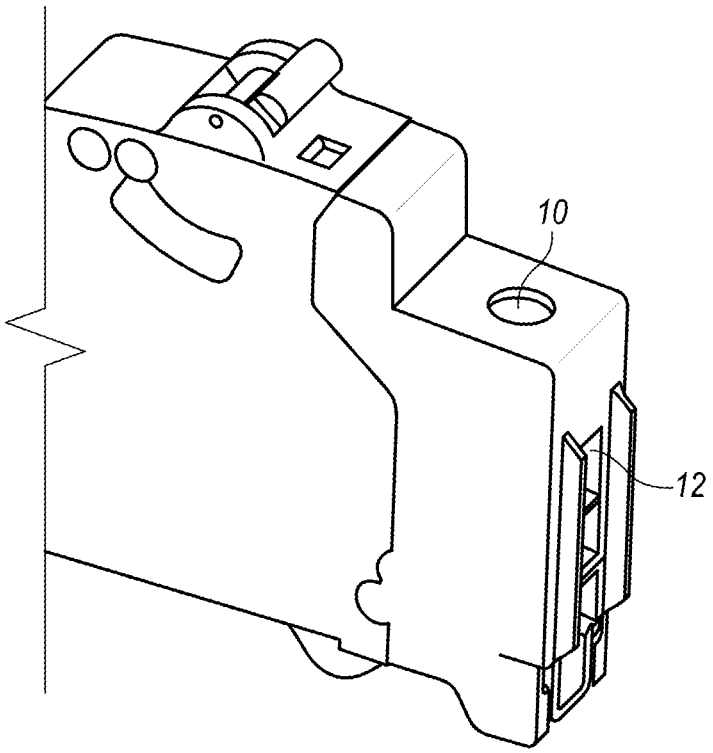
FIG. 1A (PRIOR ART)
FIG. 1A shows a prior art ABB PROLINE brand circuit breaker.
Figure 1B:
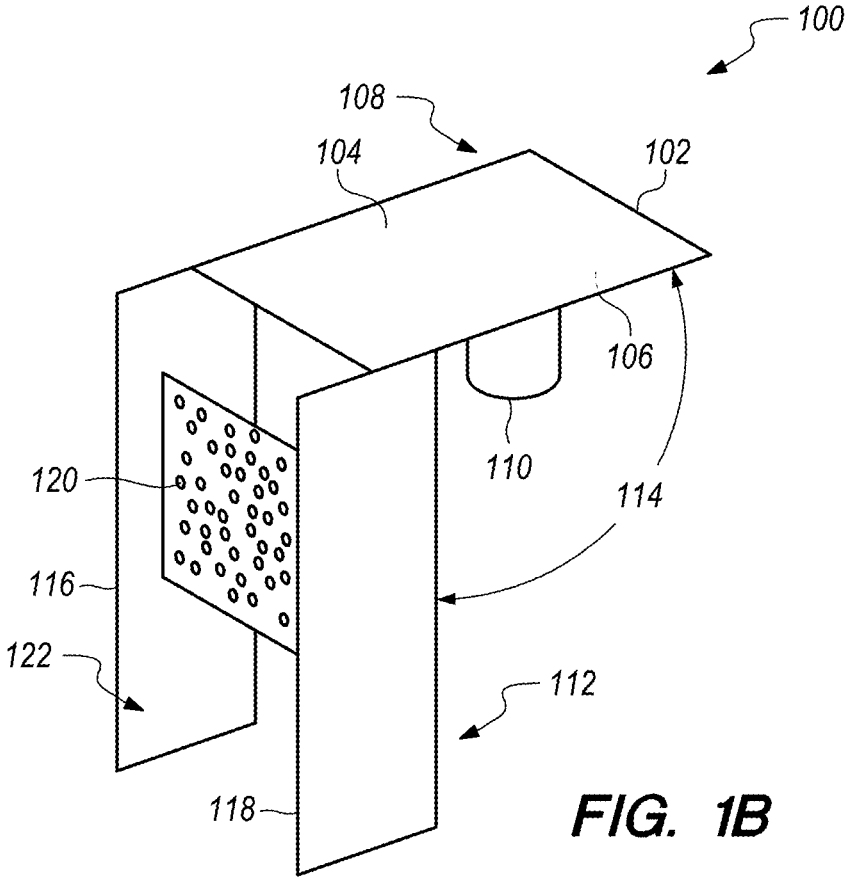
FIG. 1B is a front/left/top perspective view of an exemplary terminal cover.
Figure 2:
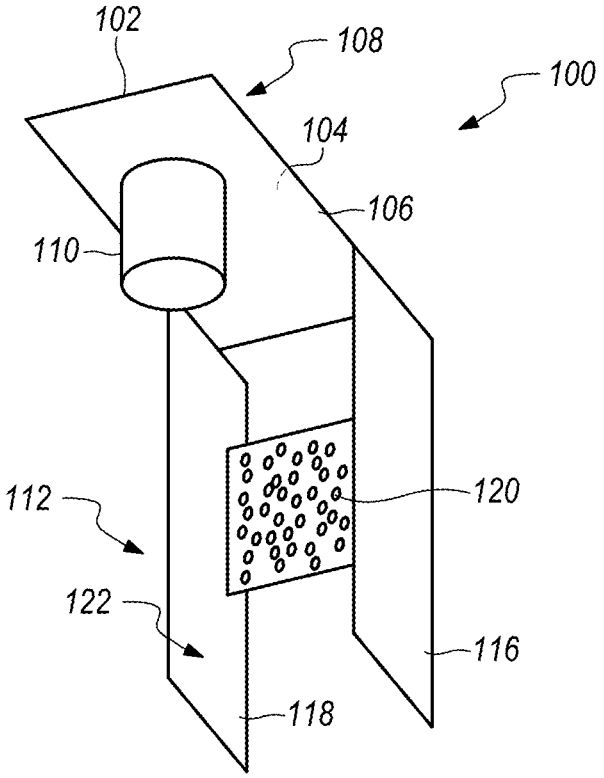
FIG. 2 is a rear/right/bottom perspective view of the exemplary terminal cover of FIG. 1.

Referring now to FIGS. 1B and 2, an exemplary terminal cover 100 is shown. The terminal cover 100 has a base 102 that has a first surface 104, a second surface 106, and an end 108. An attachment projection 110 extends from the second surface 106 of the base 102. In exemplary embodiments, attachment projection 110 is a projection from the second surface 106 that is inserted into and retained by the circuit breaker being covered. A cover 112 extends at an angle 114 from the base 102. The cover 112 includes first and second side walls 116, 118 and surface 120 that extends between the first and second side walls 116, 118. In some exemplary embodiments, surface 120 is vented. The first and second side walls 116, 118 extend to form a wire opening 122 in the cover 112. In some exemplary embodiments, the terminal cover 100 includes more than one attachment projection 110, and the different attachment projections 110 can extend from any one of the first surface 104, the second surface 106, and the cover 112.

Figure 3:
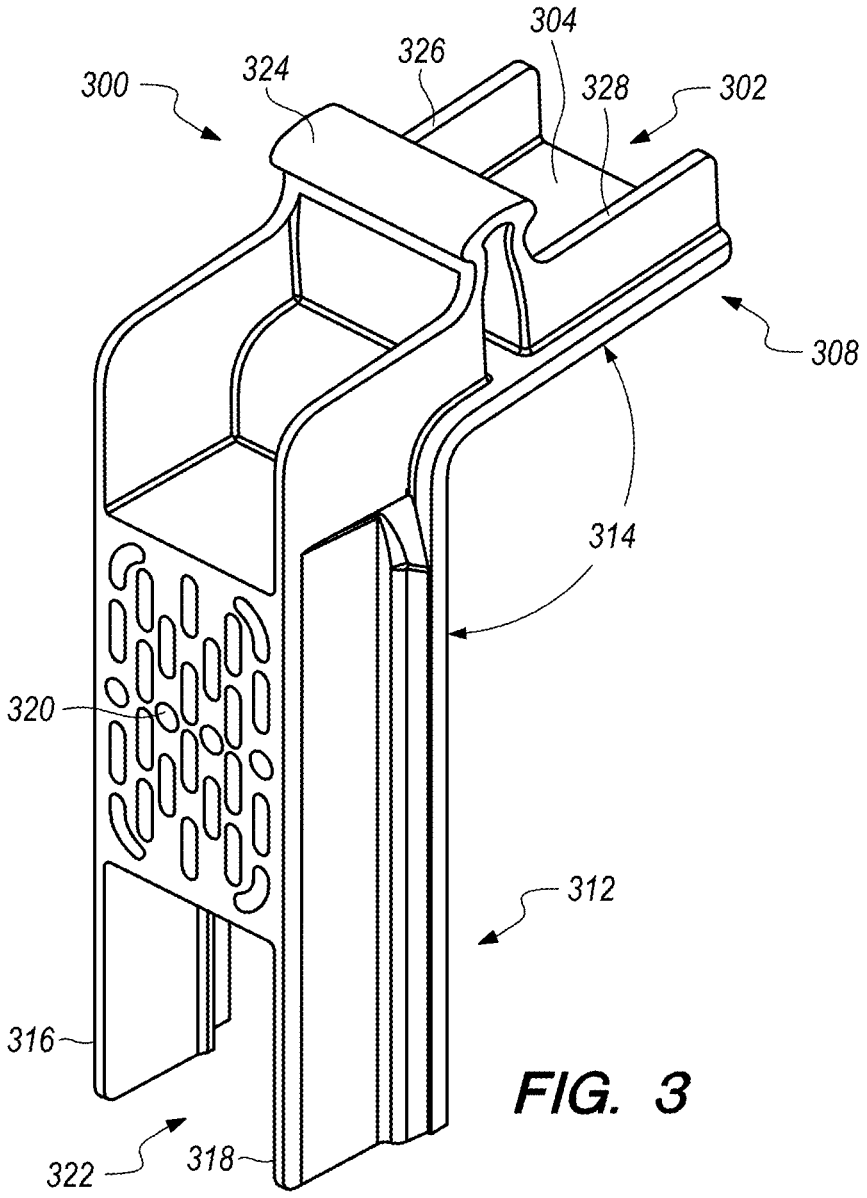
FIG. 3 is a front/left/top perspective view of a second embodiment of an exemplary terminal cover.
Figure 4:
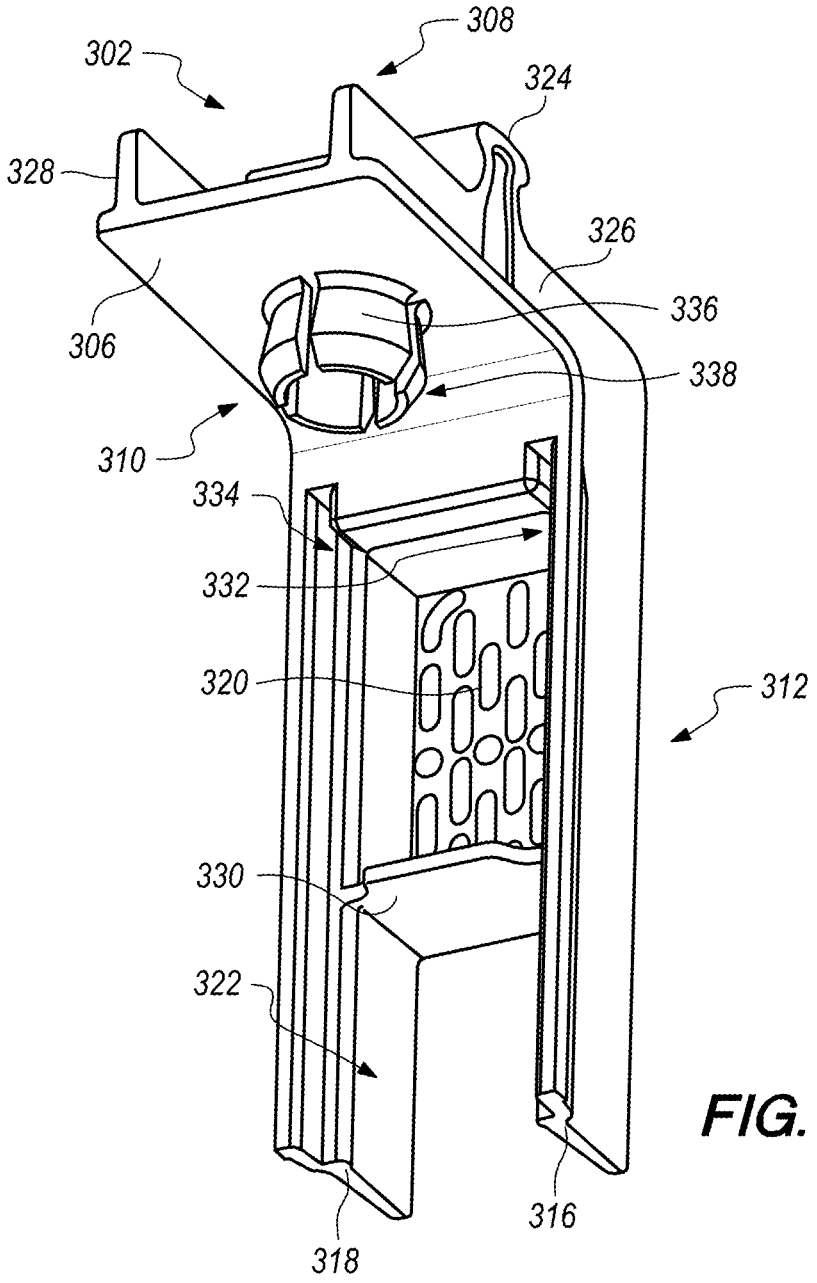
FIG. 4 is a rear/right/bottom perspective view of the exemplary terminal cover of FIG. 3.
Figure 5:
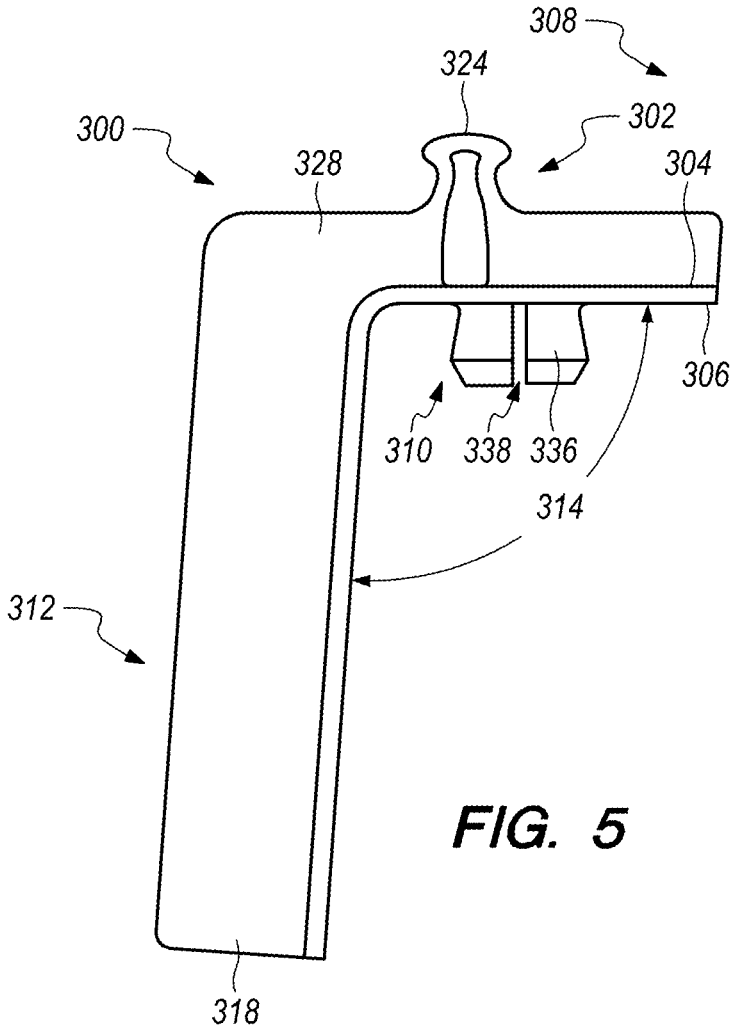
FIG. 5 is a left side view of the exemplary terminal cover of FIG. 3.
Figure 6:
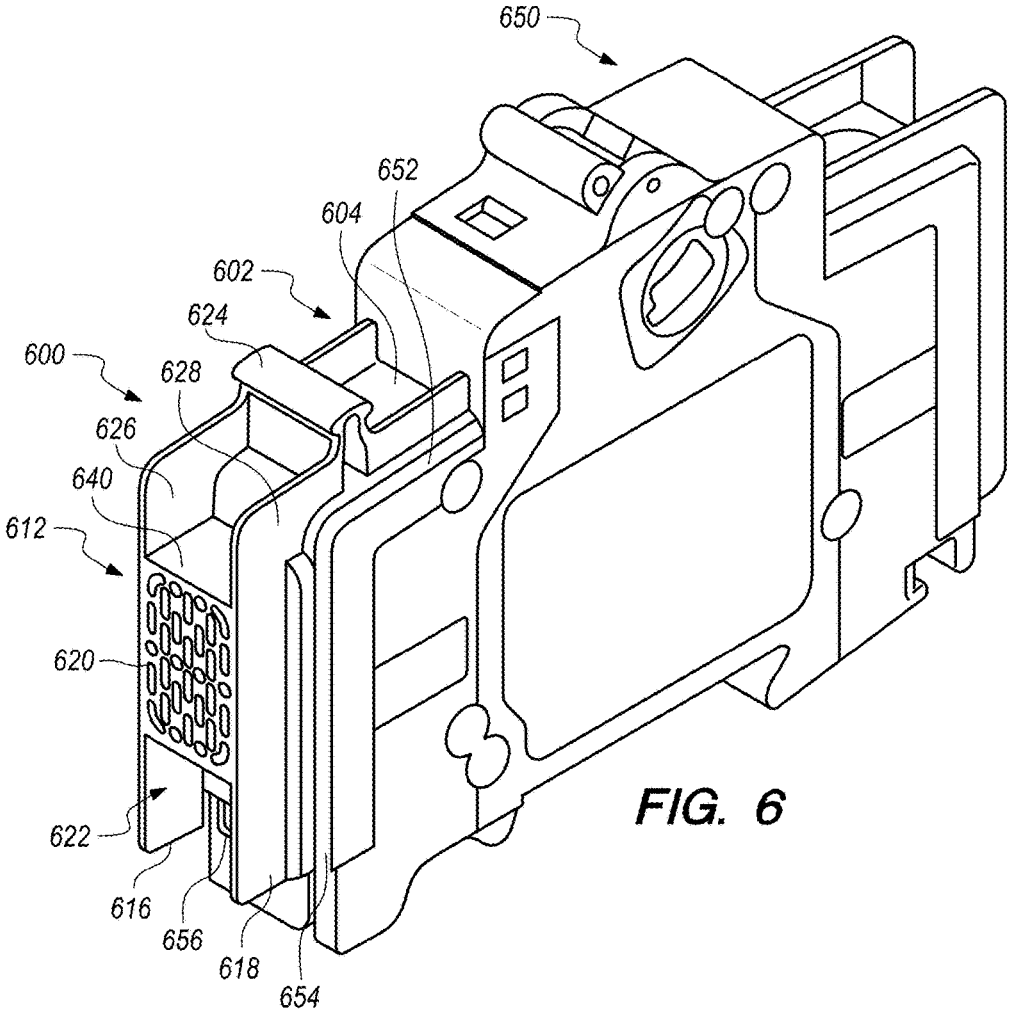
FIG. 6 is a front/left/top perspective view of an exemplary terminal cover assembled to a circuit breaker.
Figure 7:
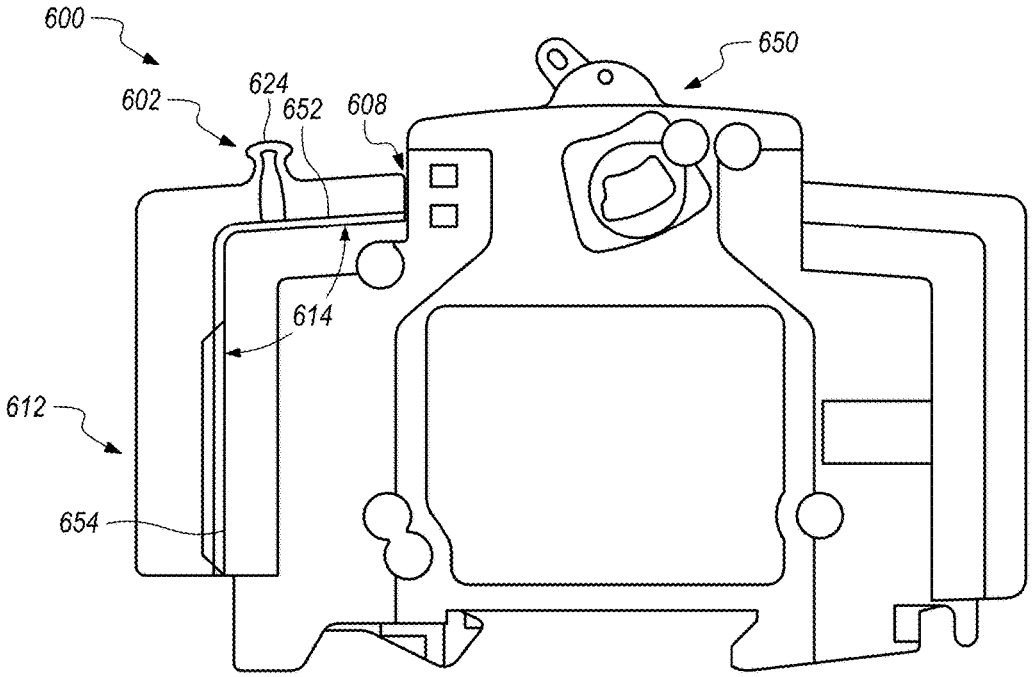
FIG. 7 is a side view of the exemplary terminal cover and circuit breaker of FIG. 6.
Figure 8:
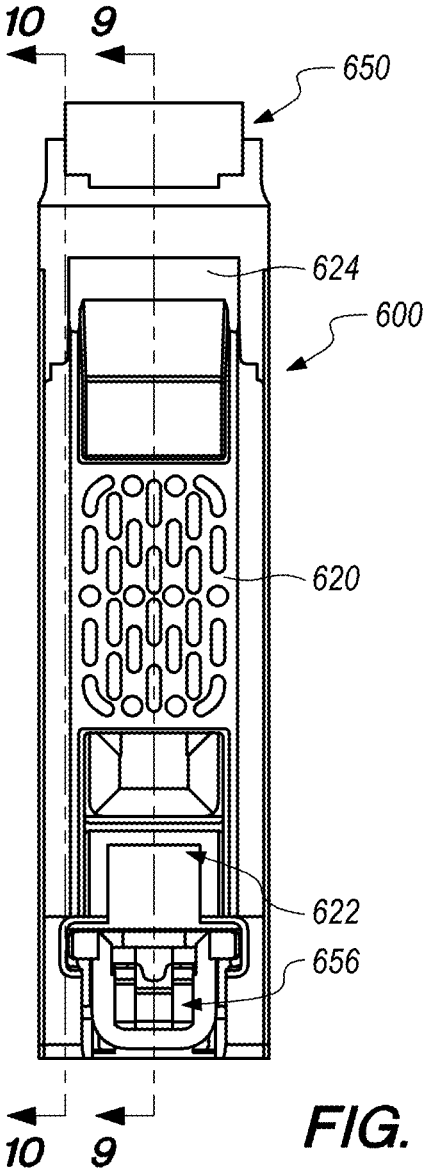
FIG. 8 is a front view of the exemplary terminal cover and circuit breaker of FIG. 6.
Figure 9:
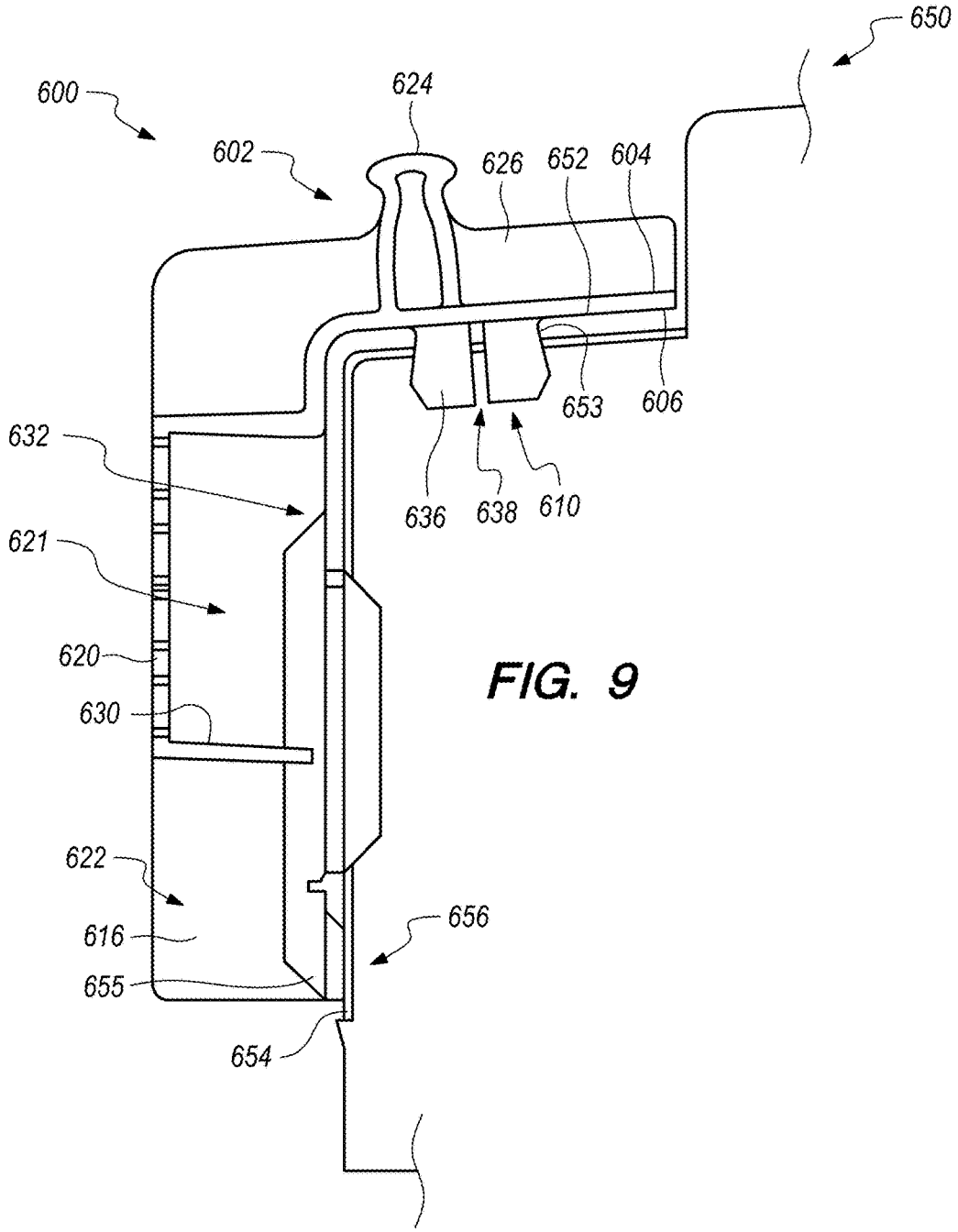
FIG. 9 is a cross-sectional view of the exemplary terminal cover and circuit breaker of FIG. 6 along the line 9-9 in FIG. 8.
Figure 10:
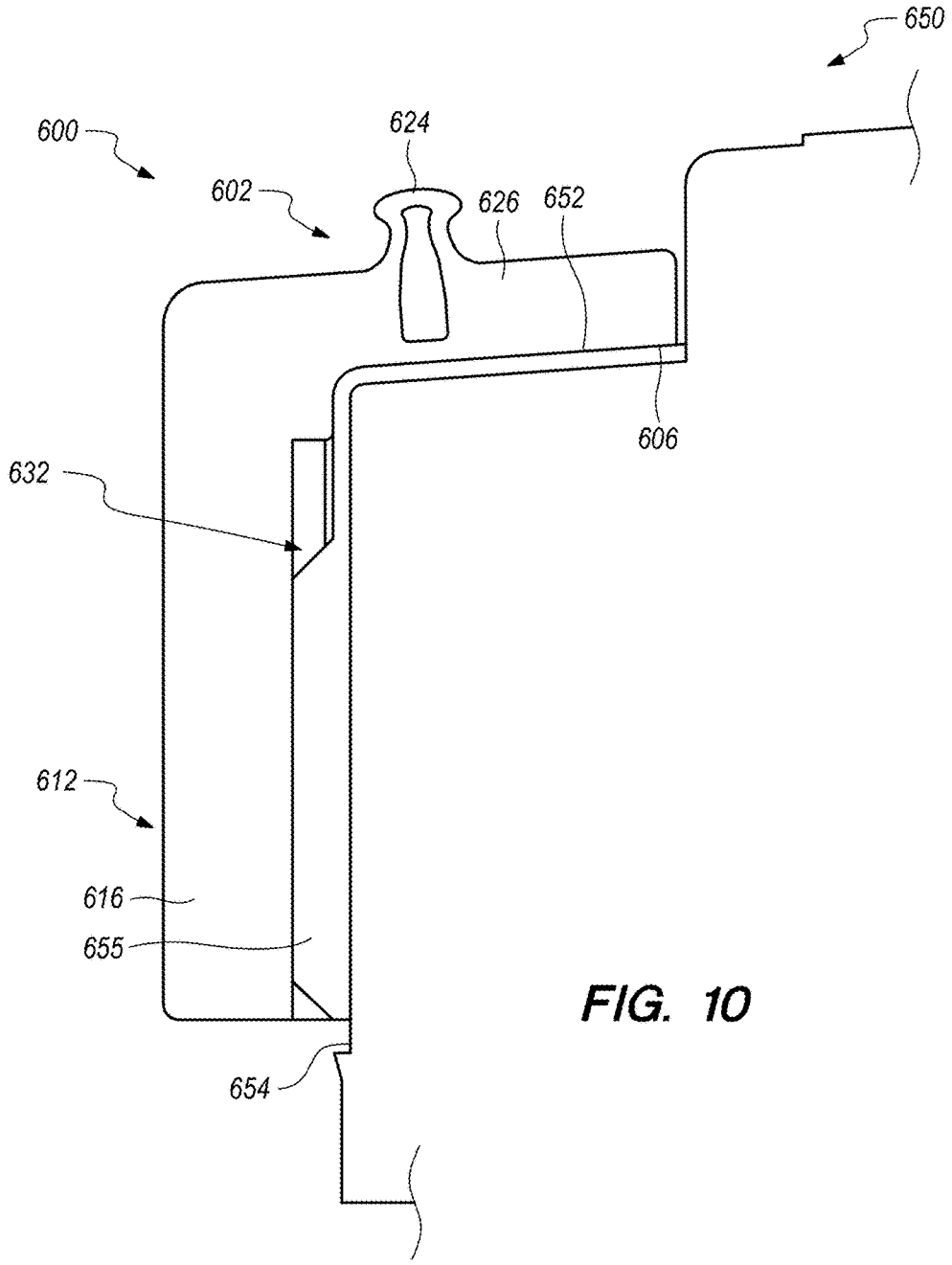
FIG. 10 is a cross-sectional view of the exemplary terminal cover and circuit breaker of FIG. 6 along the line 10-10 in FIG. 8.

Referring now to FIGS. 3-5, another exemplary embodiment of a terminal cover 300 is shown. The terminal cover 300 has a base 302 that has a first surface 304, a second surface 306, and an end 308. An attachment projection 310 extends from the second surface 306 of the base 302. The attachment projection 310 includes a plurality of flexible members 336 separated by gaps 338. A cover 312 extends at an angle 314 from the base 302. The cover 312 includes first and second side walls 316, 318 and a vented surface 320 that extends between the first and second side walls 316, 318. The first and second side walls 316, 318 extend to form a wire opening 322 in the cover 312.

An optional handle portion 324 extends from the first surface 304 of the base 302. First and second upper walls 326, 328 extend from the first surface 304 of the base 302 to increase the rigidity of the terminal cover 300. The first and second upper walls 326, 328 of the base 302 may be aligned with the first and second side walls 316, 318 of the cover 312. A barrier 330 extends between the first and second side walls 316, 318 of the cover 312, separating the vented surface 320 from the wire opening 322.

A first recess 332 is formed in the first side wall 316 and the barrier 330. A second recess 334 is formed in the second side wall 318 and the barrier 330. The first and second recesses 332, 334 are configured to receive protrusions of a circuit breaker (not shown) to align and limit the lateral motion of the terminal cover 300 on the circuit breaker (not shown).

Referring now to FIGS. 6-10, another exemplary embodiment of a terminal cover 600 is shown assembled to a circuit breaker 650. The terminal cover 600 has a base 602 that has a first surface 604, a second surface 606, and an end 608. An attachment projection 610 extends from the second surface 606 of the base 602. A cover 612 extends at an angle 614 from the base 602. The cover 612 includes first and second side walls 616, 618 and a vented surface 620 that extends between the first and second side walls 616, 618. The first and second side walls 616, 618 extend to form a wire opening 622 in the cover 612. In the illustrated embodiment, an optional safety marking 640 is included on the terminal cover 600 to indicate that the presence of high voltage that is a potential safety hazard.

Optional handle portion 624 extends from the first surface 604 of the base 602. First and second upper walls 626, 628 extend from the first surface 604 of the base 602 to increase the rigidity of the terminal cover 600. The first and second upper walls 626, 628 of the base 602 may be aligned with the first and second side walls 616, 618 of the cover 612. A barrier 630 extends between the first and second side walls 616, 618 of the cover 612, separating the vented surface 620 from the wire opening 622.

The circuit breaker 650 has a first surface 652, a second surface 654, and a terminal connector 656. An opening 653 (e.g., opening 10 in FIG. 1A) in the first surface 652 receives the attachment projection 610 of the terminal cover 600. In some exemplary embodiments, the attachment projection 610 includes a plurality of flexible members 636 separated by gaps 638. The gaps 638 allow the flexible members 636 to elastically deform inward when the attachment projection 610 is inserted in the opening 653. The flexible members 653 then expand outward and grip the opening 653, retaining the terminal cover 600 on the circuit breaker 650 and preventing inadvertent removal of the terminal cover 600.

Like terminal cover 300, recesses are formed in the first side wall 616, the second side wall 618, and barrier 630 of the terminal cover 600. Only a first recess 632 is visible in FIGS. 6-10. The circuit breaker 650 includes protrusions 655 extending from the second face 654 that are received by the recesses of the terminal cover 600. The recesses align and limit the lateral motion of the terminal cover 600 when it is attached to the circuit breaker 650.

When the terminal cover 600 is attached to the circuit breaker 650, a vent space 621 is formed by the first and second side walls 616, 618, the vented surface 620, and the barrier 630 of the terminal cover 600, and the second face 654 of the breaker 650. During normal use, electric current flowing through a wire connected to the terminal connector 656 generates heat because of the resistance of the wire and terminal connector. The vent space 621 allows heated air near the terminal connector 656 to flow away from the circuit breaker 650, preventing heat buildup that could cause the circuit breaker 650 to trip.

Some exemplary embodiments, e.g., the embodiments of FIGS. 3-10, are molded as a single unitary piece from plastic, e.g., Subic CYCOLAC™ Resin FR15U, DuPont ZYTEL® 101, ABS plastics that are UL94V rated, nylon resins that are UL94V rated, or any other moldable material that is a dielectric insulator, does not burn with an open flame, is fatigue resistant, heat resistant, chemical resistant, and dimensionally stable.

Figure 11:
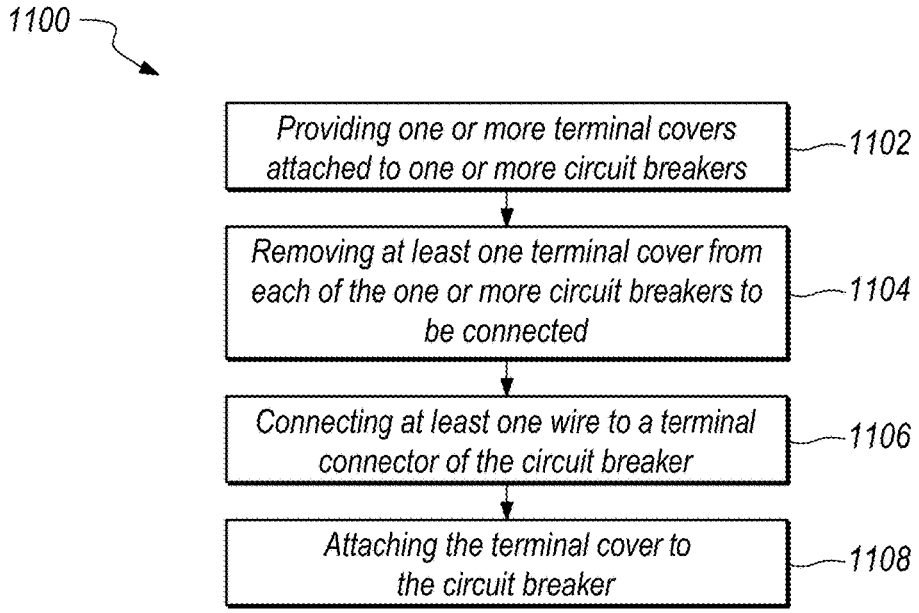
FIG. 11 is a flow chart describing the steps of an exemplary method of using circuit breaker terminal covers.

Referring now to FIG. 11, a flow chart of an exemplary method 1100 of using a circuit breaker terminal cover is shown. The exemplary method 1100 includes: providing one or more terminal covers attached to one or more circuit breakers, at 1102; removing at least one terminal cover from each of the one or more circuit breakers to be connected, at 1104; connecting at least one wire to a terminal connector of the circuit breaker, at 1106; and attaching the terminal cover to the circuit breaker, at 1108. The exemplary method 1100 can be implemented with any of the exemplary terminal covers 300, 600 described above, or another terminal cover.

FIGS. 12-21 show exemplary terminal covers 1200-2100 assembled to circuit breakers 1250-2150. Like the terminal covers 300, 600 described above, each terminal cover 1200-

2100 includes a vented surface that encloses a vent space when assembled to the circuit breakers 1250-2150.

Figure 12:
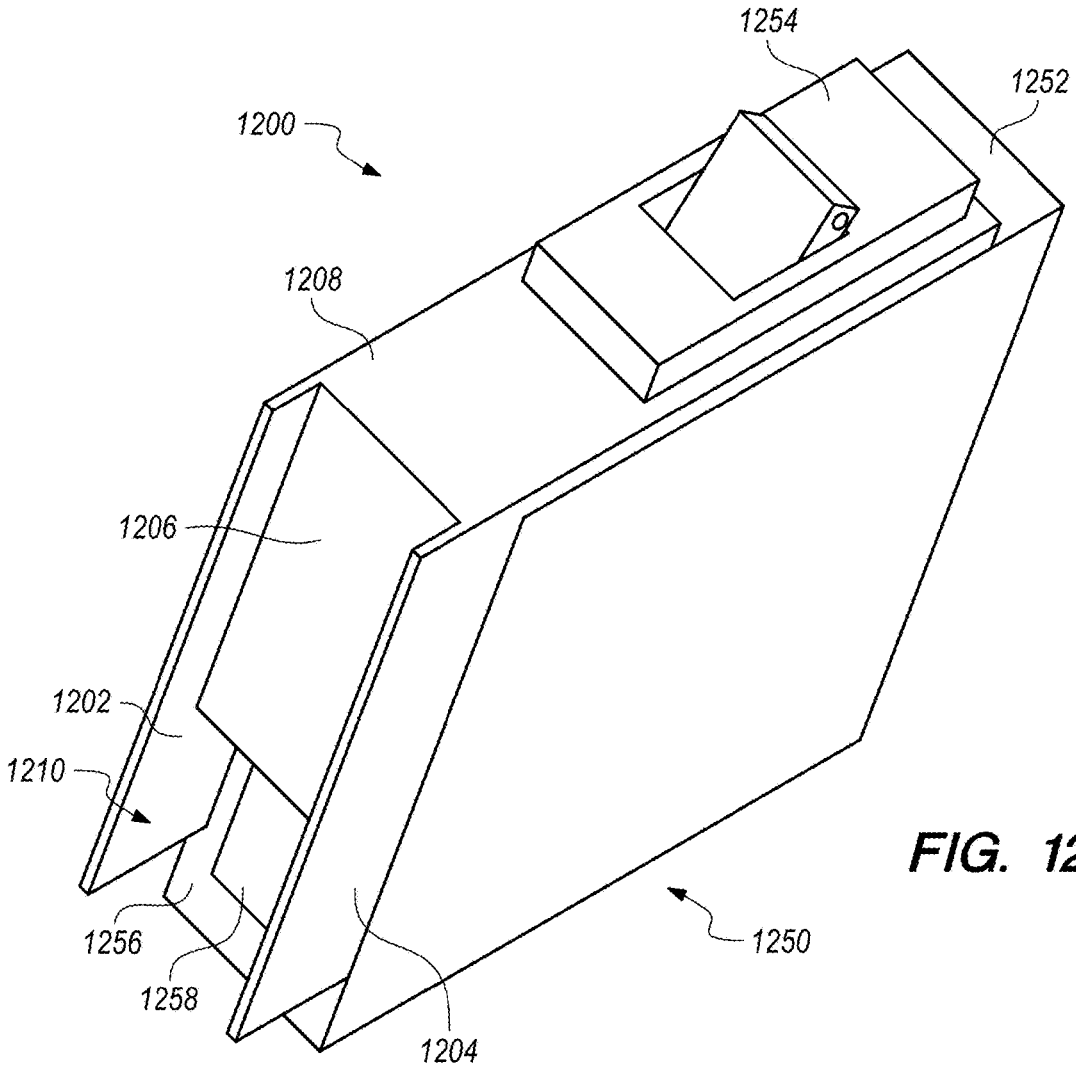
FIG. 12 is a front/left/top perspective view of yet another exemplary circuit breaker terminal cover assembled to a circuit breaker.

Referring now to FIG. 12, another exemplary embodiment of a terminal cover 1200 is shown. The terminal cover 1200 has a first side wall 1202, a second side wall 1204, a vented surface 1206 that extends between the first and second side walls 1202, 1204, and an attachment portion 1208. The first and second side walls 1202, 1204 extend to form a wire opening 1210. The terminal cover 1200 is attached to a circuit breaker 1250 that has a top surface 1252, a panel mount projection 1254, a front surface 1256, and a terminal connector 1258. The attachment portion 1208 of the terminal cover 1200 forms a loop that attaches to the panel mount projection 1254 of the circuit breaker 1250 to secure the terminal cover 1200 on the breaker 1250.

Figure 13:
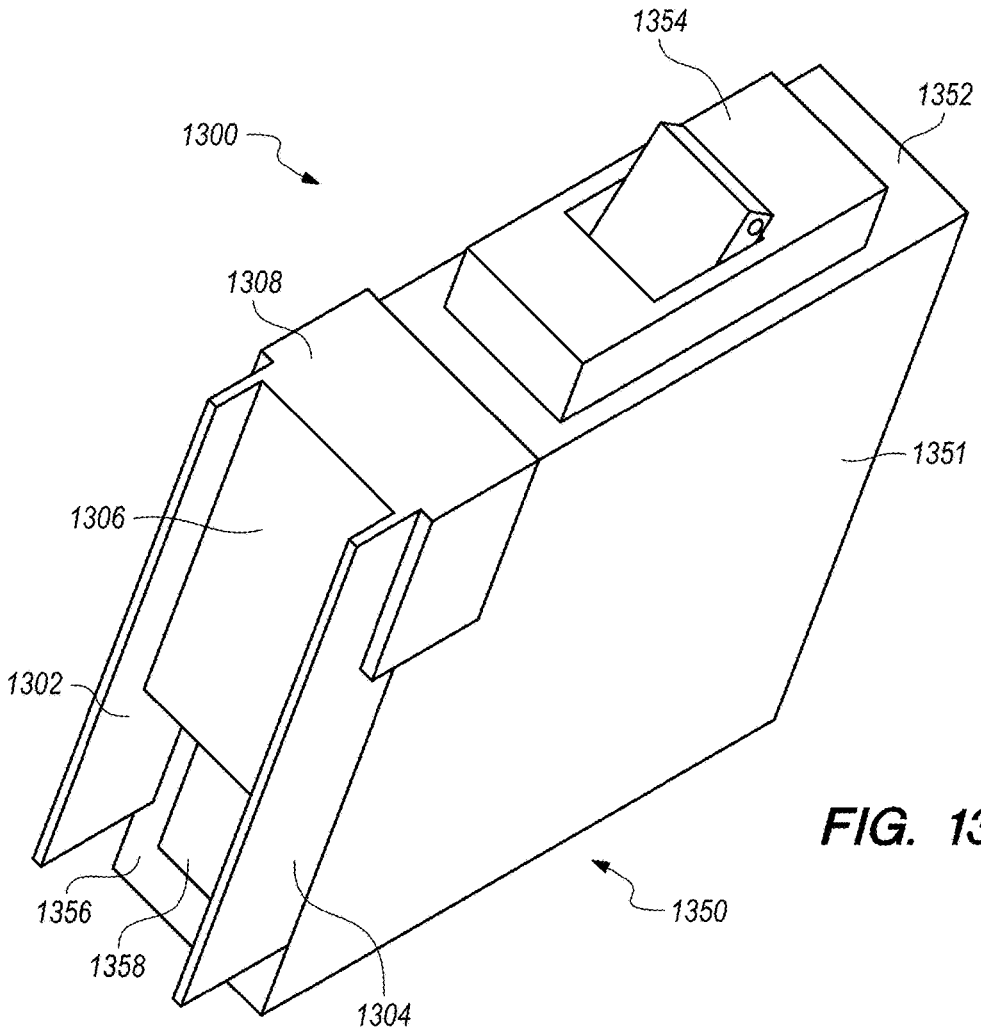
FIG. 13 is a front/left/top perspective view of still another exemplary circuit breaker terminal cover assembled to a circuit breaker.

Referring now to FIG. 13, another exemplary embodiment of a terminal cover 1300 is shown. The terminal cover 1300 has a first side wall 1302, a second side wall 1304, a vented surface 1306 that extends between the first and second side walls 1302, 1304, and an attachment portion 1308. The first and second side walls 1302, 1304 extend to form a wire opening 1310. The terminal cover 1300 is attached to a circuit breaker 1350 that has side surfaces 1351, a top surface 1352, a panel mount projection 1354, a front surface 1356, and a terminal connector 1358. The attachment portion 1308 of the terminal cover 1300 extends downward from the top surface 352 to cover at least a portion of the side surfaces 1351 of the circuit breaker 1350. The attachment portion 1308 is sized to form a friction fit connection with the side surfaces 1351 to secure the terminal cover 1300 on the breaker 1350.

Figure 14:
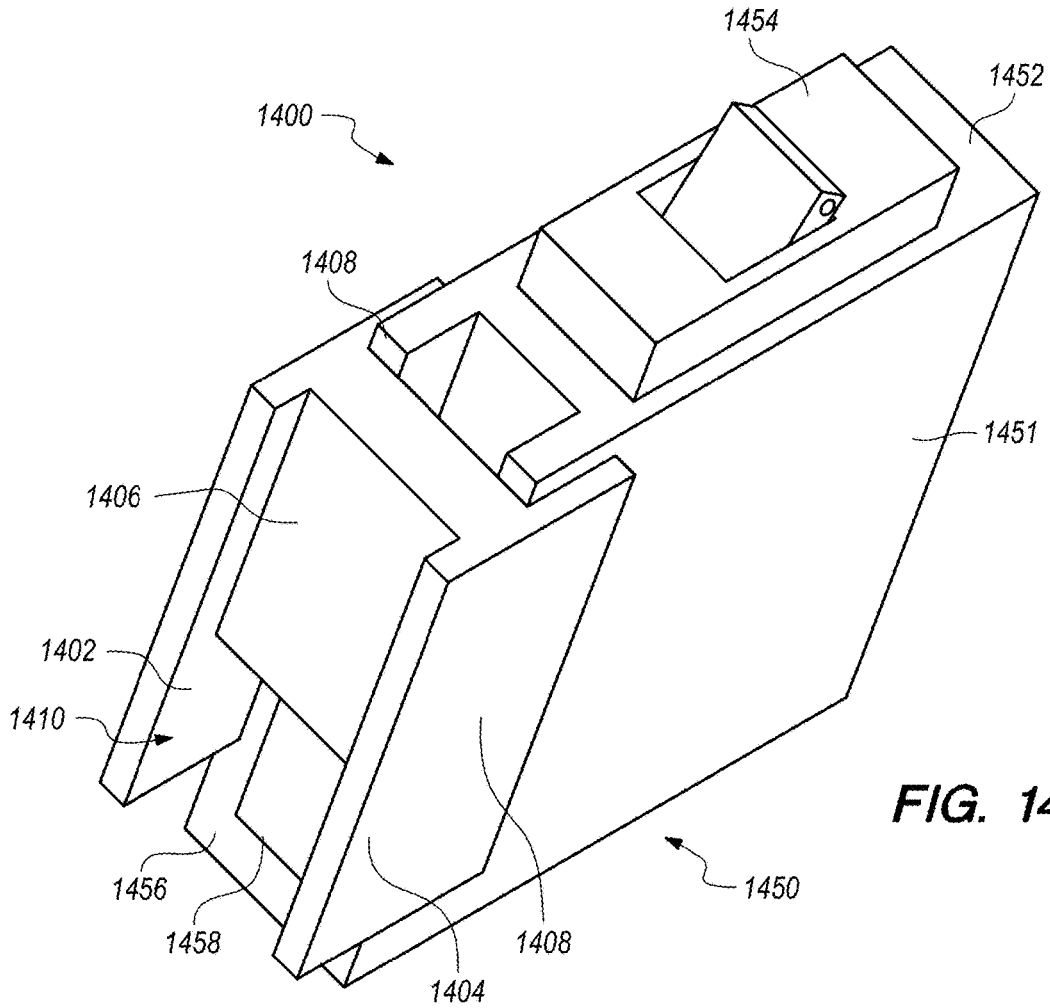
FIG. 14 is a front/left/top perspective view of yet still another exemplary circuit breaker terminal cover assembled to a circuit breaker.

Referring now to FIG. 14, another exemplary embodiment of a terminal cover 1400 is shown. The terminal cover 1400 has a first side wall 1402, a second side wall 1404, a vented surface 1406 that extends between the first and second side walls 1402, 1404, and an attachment portion 1408. The first and second side walls 1402, 1404 extend to form a wire opening 1410. The terminal cover 1400 is attached to a circuit breaker 1450 that has side surfaces 1451, a top surface 1452, a front surface 1456, and a terminal connector 1458. The attachment portion 1408 of the terminal cover 1400 extends from the first and second side walls 1402, 1404 to cover at least a portion of the side surfaces 1451. The attachment portion 1408 is sized to form a friction fit connection with the side surfaces 1451 to secure the terminal cover 1400 on the breaker 1450.

Figure 15:
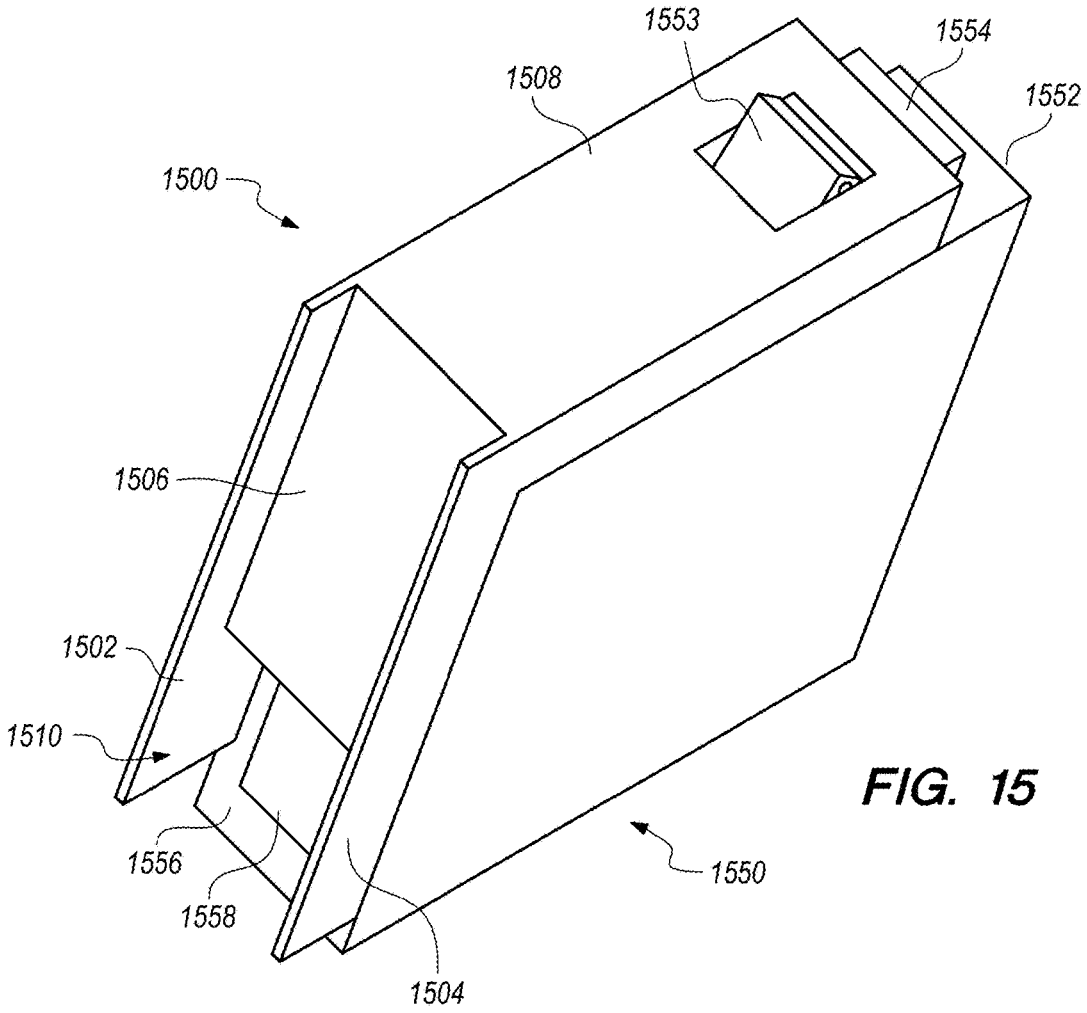
FIG. 15 is a front/left/top perspective view of another exemplary circuit breaker terminal cover assembled to a circuit breaker.

Referring now to FIG. 15, another exemplary embodiment of a terminal cover 1500 is shown. The terminal cover 1500 has a first side wall 1502, a second side wall 1504, a vented surface 1506 that extends between the first and second side walls 1502, 1504, and an attachment portion 1508. The first and second side walls 1502, 1504 extend to form a wire opening 1510. The terminal cover 1500 is attached to a circuit breaker 1550 that has a top surface 1552, a switch 1553, a panel mount projection 1554, a front surface 1556, and a terminal connector 1558. The attachment portion 1508 of the terminal cover 1500 forms a loop that attaches to the switch 1553 of the circuit breaker 1550 to secure the terminal cover 1500 on the breaker 1550.

Figure 16:
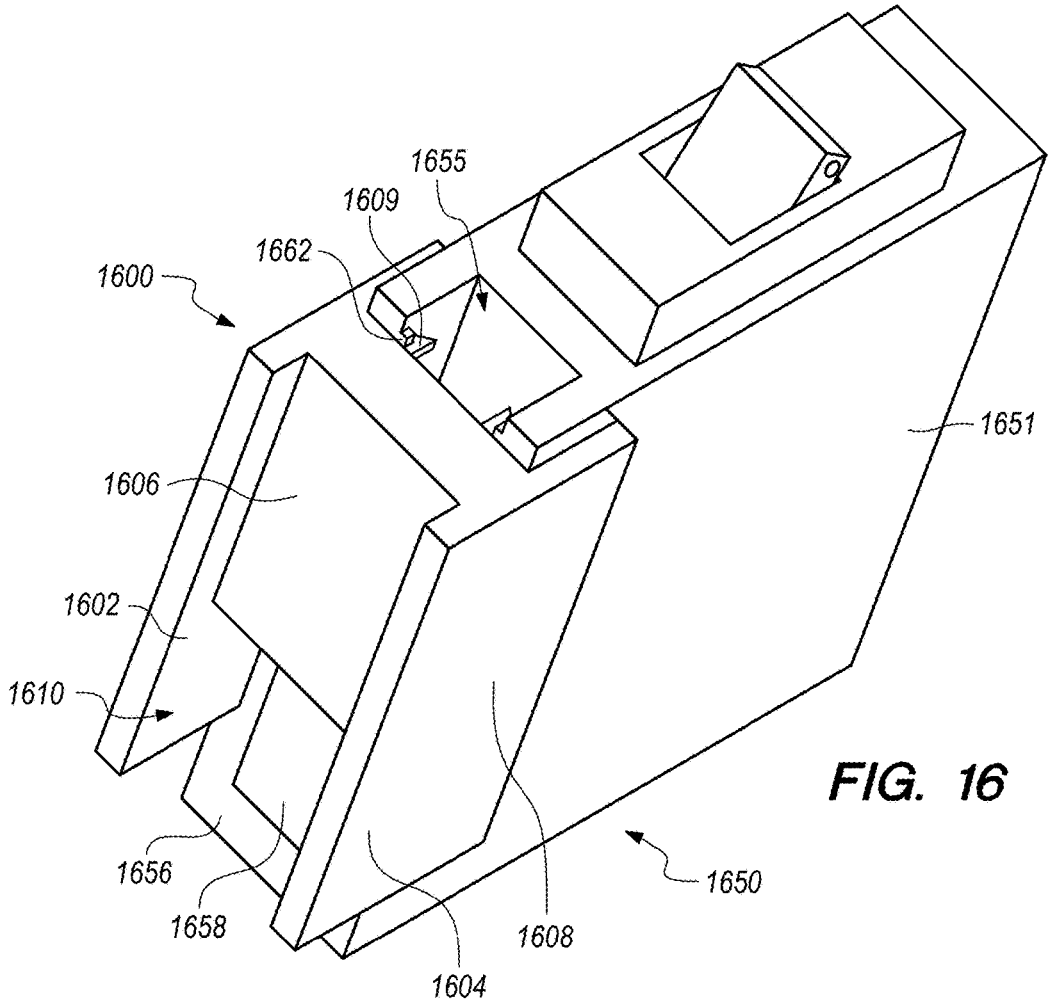
FIG. 16 is a front/left/top perspective view of yet another exemplary circuit breaker terminal cover assembled to a circuit breaker.

Referring now to FIG. 16, another exemplary embodiment of a terminal cover 1600 is shown. The terminal cover 1600 has a first side wall 1602, a second side wall 1604, a vented surface 1606 that extends between the first and second side walls 1602, 1604, and an attachment portion 1608. The first and second side walls 1602, 1604 extend to form a wire opening 1610. The terminal cover 1600 is attached to a circuit breaker 1650 that has side surfaces 1651, a front surface 1656, a terminal connector 1658, and a recess 1655 having ridges 1662. The attachment portion 1608 of the terminal cover 1600 extends from the first and second side walls 1602, 1604 to cover at least a portion of the side surfaces 1651. The attachment portion 1608 is sized to form a friction fit connection with the side surfaces 1651 to secure the terminal cover 1600 on the breaker 1650. The terminal cover 1600 also includes secondary attachment portions 1609 with a hook or barbed shape that snap or hook onto the ridges 1662 within the recess 1655 near the front surface 1656 of the circuit breaker 1650. In other embodiments, a circuit breaker can have ridges, holes, recesses, grooves, or other features in various locations on the circuit breaker that hook or barb shaped attachment portions of a terminal cover can attach onto.

Figure 17:
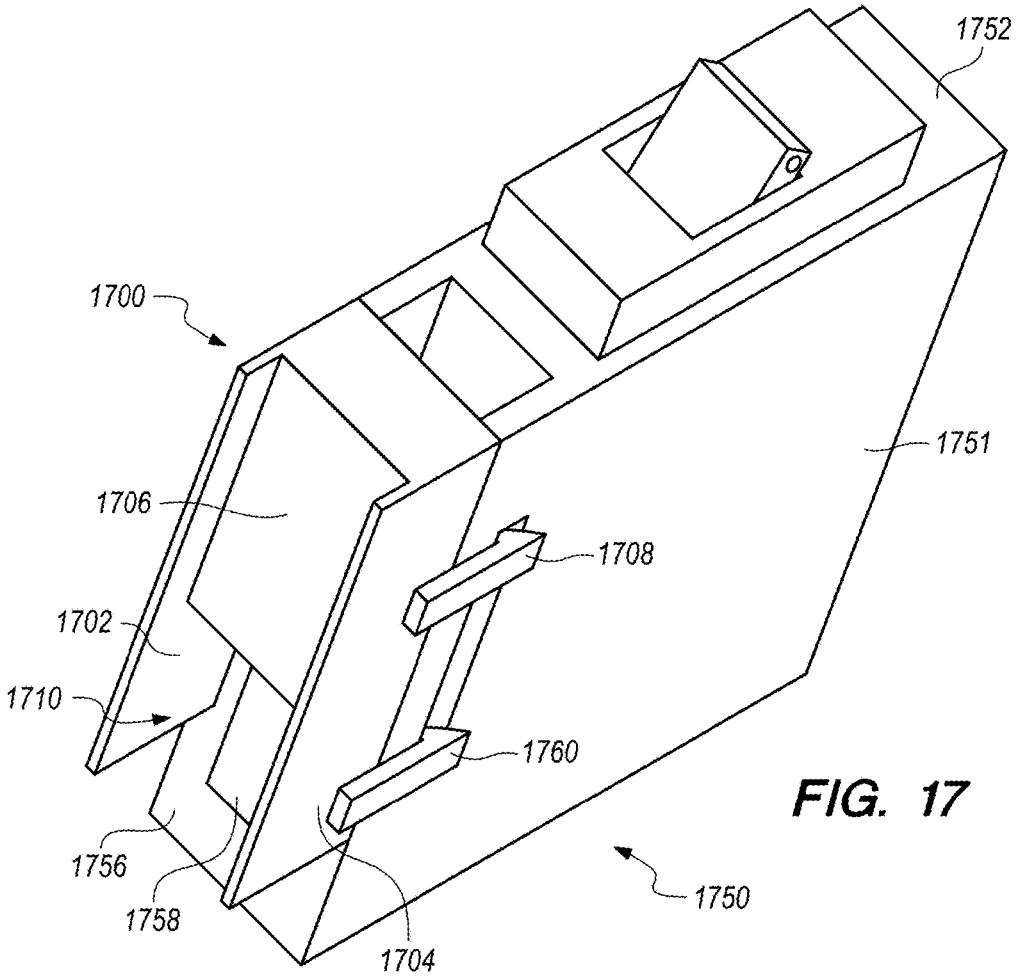
FIG. 17 is a front/left/top perspective view of still another exemplary circuit breaker terminal cover assembled to a circuit breaker.

Referring now to FIG. 17, another exemplary embodiment of a terminal cover 1700 is shown. The terminal cover 1700 has a first side wall 1702, a second side wall 1704, a vented surface 1706 that extends between the first and second side walls 1702, 1704, and an attachment portion 1708. The first and second side walls 1702, 1704 extend to form a wire opening 1710. The terminal cover 1700 is attached to a circuit breaker 1750 that has side surfaces 1751, a top surface 1752, a front surface 1756, a terminal connector 1758. Each side surface 1751 includes a recess 1760 proximate the front surface. The attachment portions 1708 of the terminal cover 1700 extend from the first and second side walls 1702, 1704 to engage the recess 1760. The attachment portions 1708 can be hook or barb shaped, or any other shape suitable for engaging the recess 1760, such as a ball detent or similar feature.

Figure 18:
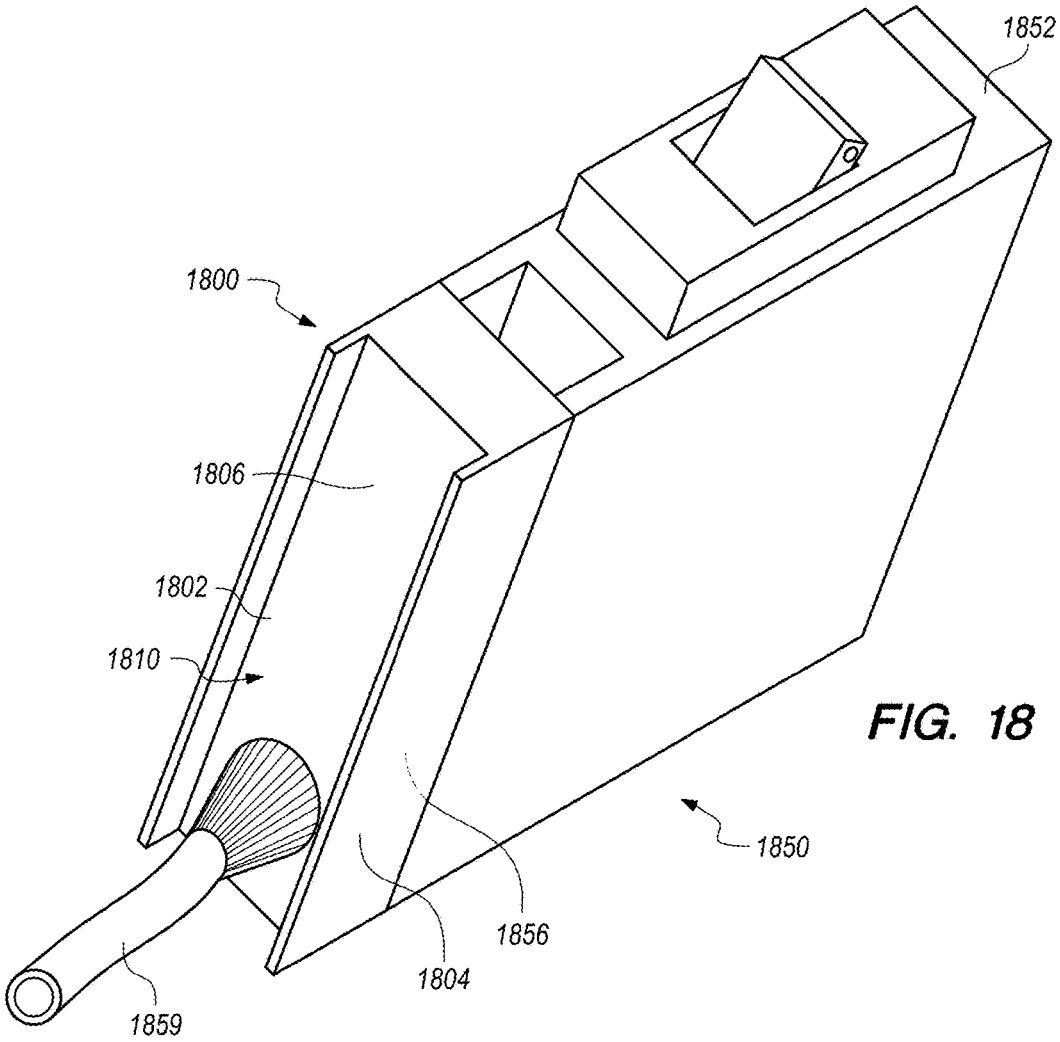
FIG. 18 is a front/left/top perspective view of yet still another exemplary circuit breaker terminal cover assembled to a circuit breaker.

Referring now to FIG. 18, another exemplary embodiment of a terminal cover 1800 is shown. The terminal cover 1800 has a first side wall 1802, a second side wall 1804, a vented surface 1806 that extends between the first and second side walls 1802, 1804, and an attachment portion 1808. The attachment portion 1808 surrounds a wire opening 1810. The terminal cover 1800 is attached to a circuit breaker 1850 that has a top surface 1852, and a front surface 1856, and a wire 1859 extending from a terminal connector (not shown). The wire 1859 passes through the wire opening 1810 to reach the circuit breaker 1850. The attachment portion 1808 includes a plurality of fingers or barbs that extend from the wire opening 1810 to engage the insulation of the wire 1859. The attachment portion 1808 allows the terminal cover 1800 to slide along the wire 1859 toward the circuit breaker 1850 but prevents the terminal cover 1800 from sliding away from the circuit breaker 1850, securing the terminal cover 1800 on the breaker 1850.

Figure 19:
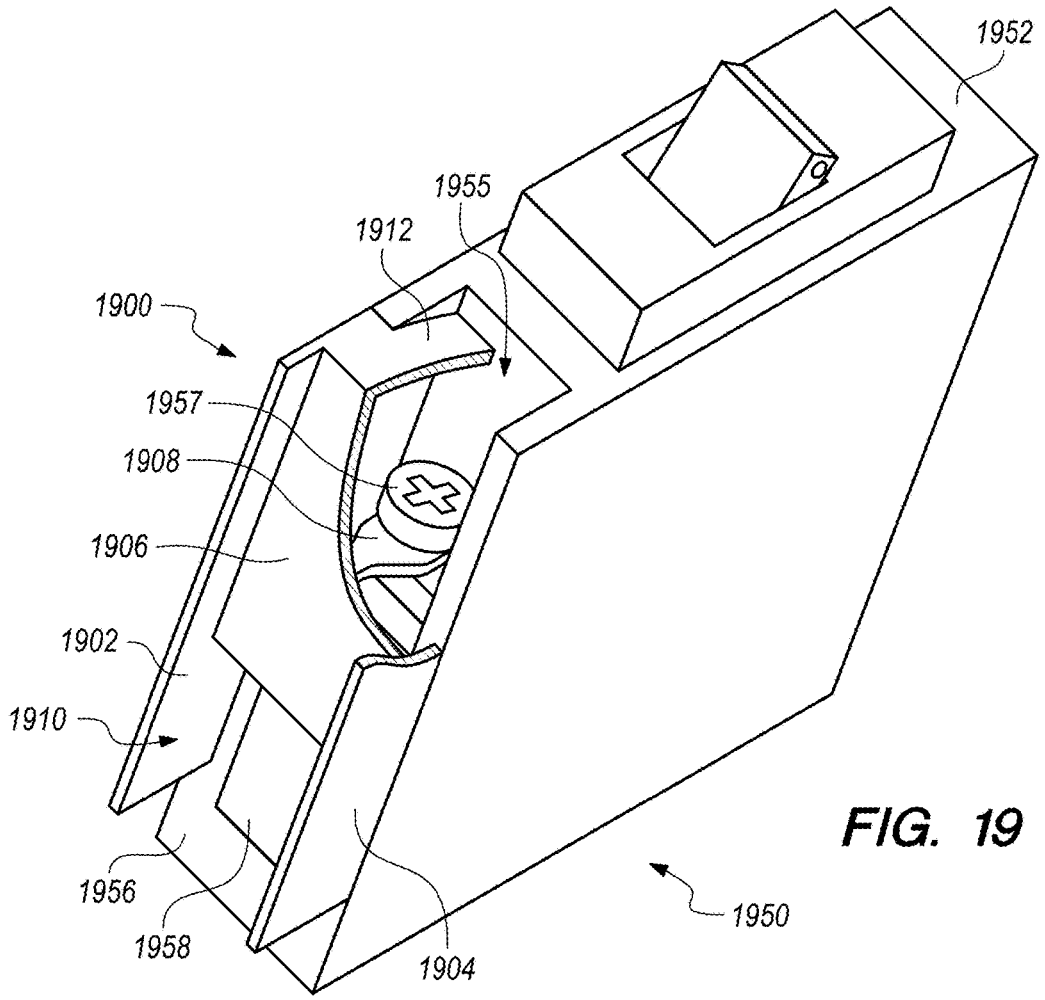
FIG. 19 is a front/left/top perspective view of another exemplary circuit breaker terminal cover assembled to a circuit breaker.

Referring now to FIG. 19, another exemplary embodiment of a terminal cover 1900 is shown. The terminal cover 1900 has a first side wall 1902, a second side wall 1904, a vented surface 1906 that extends between the first and second side walls 1902, 1904, and an attachment portion 1908. The first and second side walls 1902, 1904 extend to form a wire opening 1910. The terminal cover 1900 is attached to a circuit breaker 1950 that has a top surface 1952, a recess 1955, a front surface 1956, a terminal screw, and a terminal connector 1958. The attachment portion 1908 of the terminal cover 1900 forms a washer or fork that is inserted under the terminal screw 1957 to secure the terminal cover 1900 on the breaker 1950. The terminal cover 1900 also includes a flexible portion 1912 that covers the recess 1955 and terminal screw 1957 but can be moved to access the terminal screw 1957 with a tool.

Figure 20:
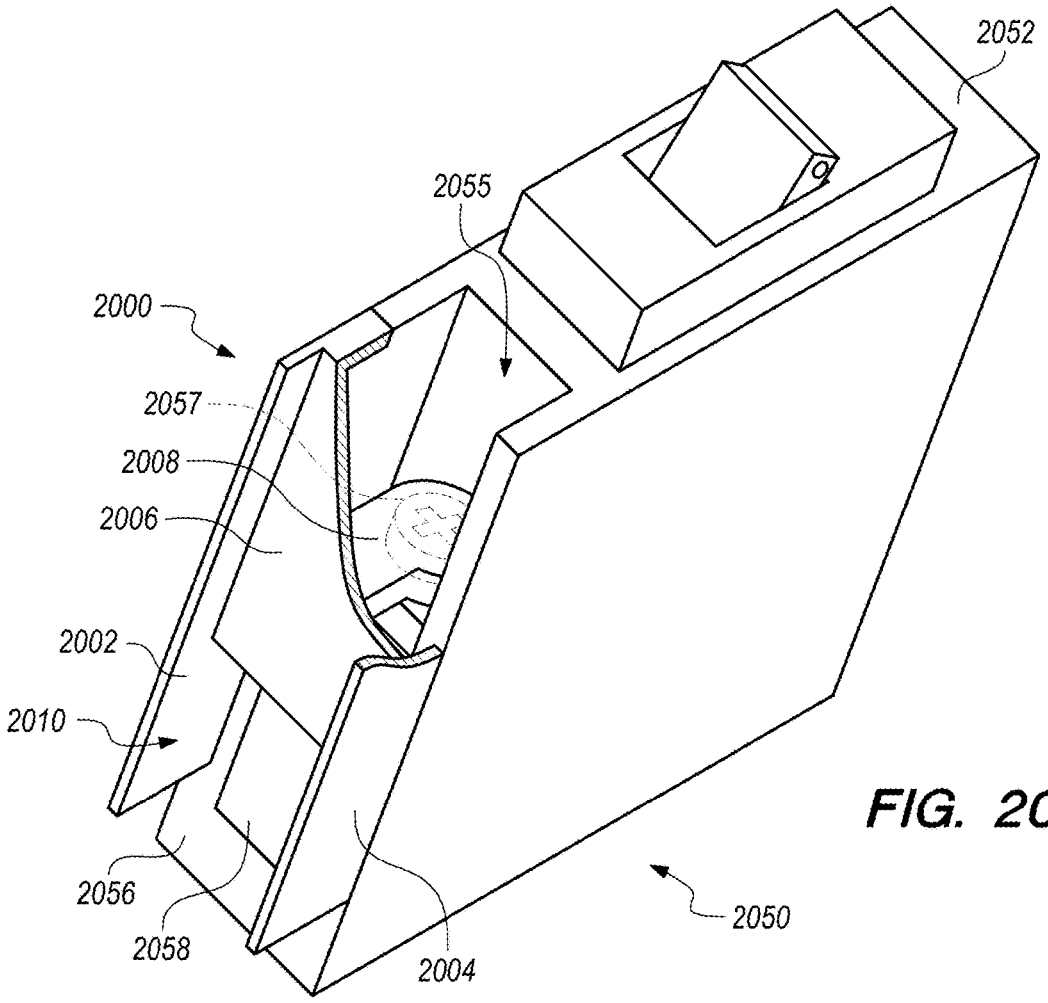
FIG. 20 is a front/left/top perspective view of yet another exemplary circuit breaker terminal cover assembled to a circuit breaker.

Referring now to FIG. 20, another exemplary embodiment of a terminal cover 2000 is shown. The terminal cover 2000 has a first side wall 2002, a second side wall 2004, a vented surface 2006 that extends between the first and second side walls 2002, 2004, and an attachment portion 2008. The first and second side walls 2002, 2004 extend to form a wire opening 2010. The terminal cover 2000 is attached to a circuit breaker 2050 that has a top surface 2052, a recess 2055, a front surface 2056, a terminal screw 2057, and a terminal connector 2058. The attachment portion 2008 of the terminal cover 2000 forms a cup that fits around the terminal screw 1957 to secure the terminal cover 2000 to the breaker 2050.

Figure 21:
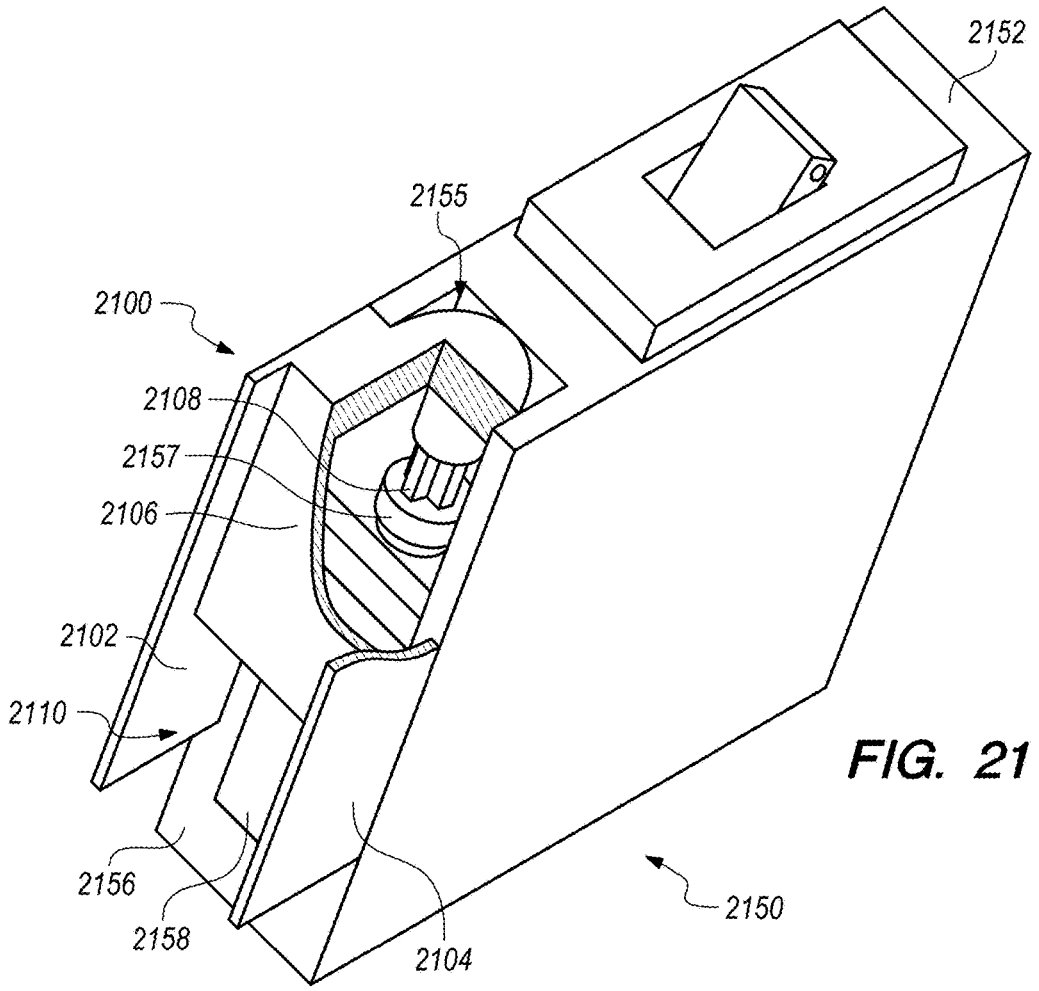
FIG. 21 is a front/left/top perspective view of still another exemplary circuit breaker terminal cover assembled to a circuit breaker.

Referring now to FIG. 21, another exemplary embodiment of a terminal cover 2100 is shown. The terminal cover 2100 has a first side wall 2102, a second side wall 2104, a vented surface 2106 that extends between the first and second side walls 2102, 2104, and an attachment portion 2108. The first and second side walls 2102, 2104 extend to form a wire opening 2110. The terminal cover 2100 is attached to a circuit breaker 2150 that has a top surface 2152, a recess 2155, a front surface 2156, a terminal screw 2157, and a terminal connector 2158. The attachment portion 2108 of the terminal cover 2100 forms a projection that engages a recess in the terminal screw 2157 to secure the terminal cover 2100 on the breaker 2150.

Figure 22:
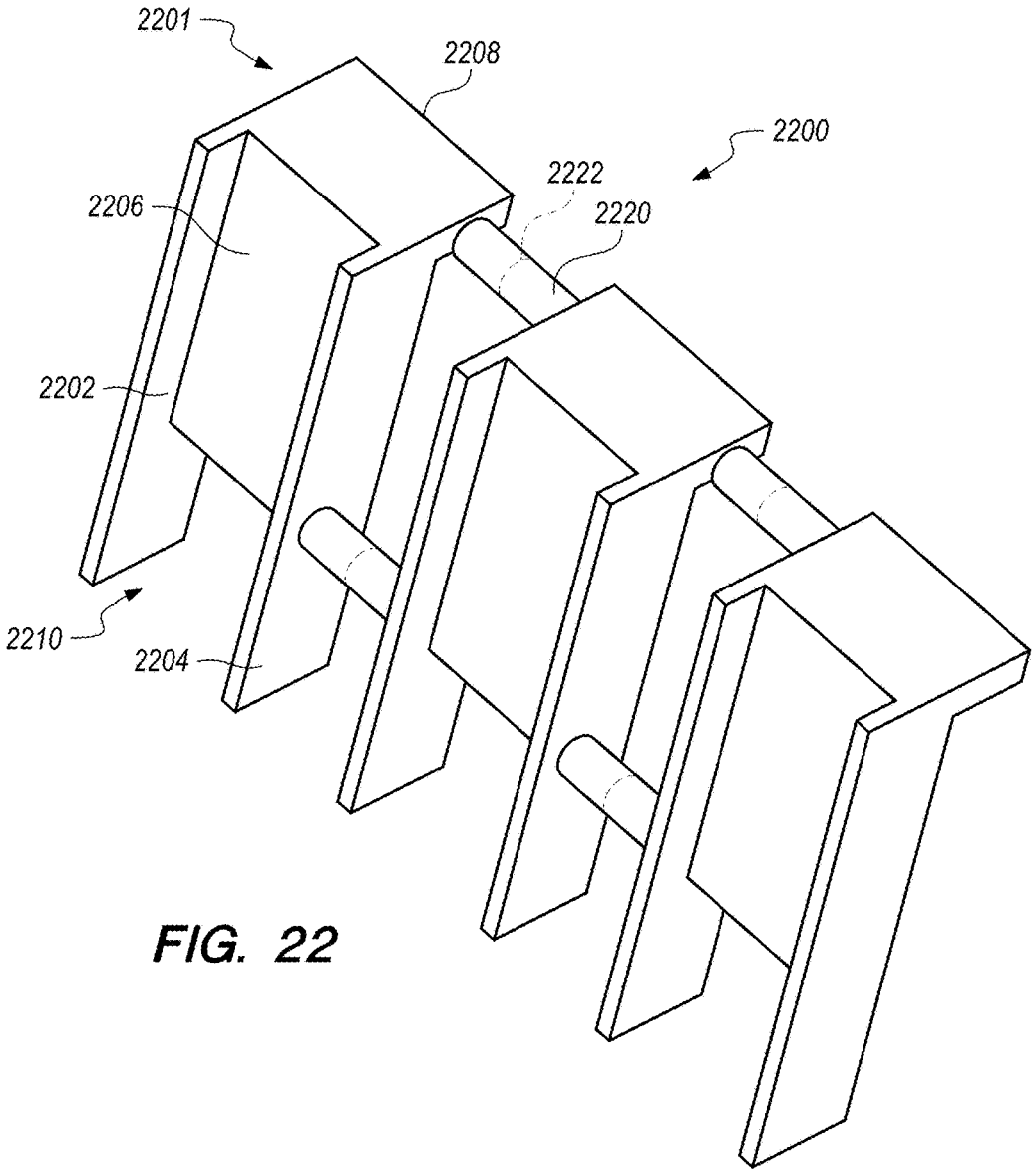
FIG. 22 is a front/left/top perspective view of an exemplary strip of circuit breaker terminal covers.

Referring now to FIG. 22, an exemplary embodiment of a strip of terminal covers 2200 is shown. The strip of terminal covers 2200 includes a plurality of terminal covers 2201 joined together by frangible connections 2220. Each terminal cover 2201 has a first side wall 2202, a second side wall 2204, a vented surface 2206 that extends between the first and second side walls 2202, 2204, and an attachment portion 2208. The first and second side walls 2202, 2204 extend to form a wire opening 2210. The attachment portion 2208 can be any attachment portion described in any of the embodiments above, so long as it does not envelop a wire attached to a circuit breaker. The frangible connections 2220 can include an area of weakness 2222 so that they break in a particular location. Groups of terminal covers 2201 can be broken off from the strip at their frangible connections 2220 to form smaller strips of terminal covers 2201. In some embodiments, a strip of terminal covers 2200 allows a plurality of adjacent covers 2201 to be installed on a plurality of adjacent circuit breakers at one time.

In some exemplary embodiments, the exemplary covers of FIGS. 12-22 are molded as a single unitary piece from plastic, e.g., Subic CYCOLAC™ Resin FR15U, DuPont ZYTEL® 101, ABS plastics that are UL94V rated, nylon resins that are UL94V rated, or any other moldable material that is a dielectric insulator, does not burn with an open flame, is fatigue resistant, heat resistant, chemical resistant, and dimensionally stable.

Figure 23:
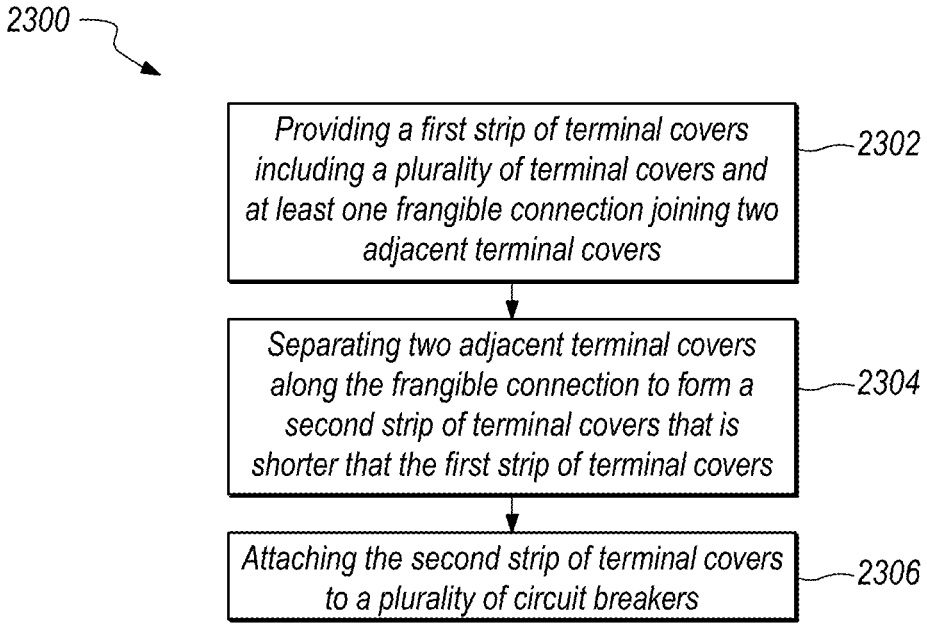
FIG. 23 is a flow chart describing the steps of an exemplary method of using a strip of circuit breaker terminal covers.

Referring now to FIG. 23, a flow chart of an exemplary method 2300 of using a strip of circuit breaker terminal covers is shown, e.g., the strips shown in FIG. 22 and described in the text accompanying FIG. 22. The exemplary method 2300 includes: providing a first strip of adjacent terminal covers comprising, at 2302; separating two adjacent terminal covers along the frangible connection to form a second strip of adjacent terminal covers that is shorter than the first strip of terminal covers, at 2304; and attaching the second strip of terminal covers to a plurality of adjacent circuit breakers, at 2306. The exemplary method 2300 can be implemented with any strip of the exemplary terminal covers described above, or another strip of terminal covers.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, the optional handle 624 could be made larger to allow removal of the terminal cover 600 while wearing gloves, or could be made so that a particular tool is required to remove the terminal cover, thereby providing tamper resistance. As yet still another example, the terminal cover 600 can be used with circuit breakers without screw holes 653 by having the edges of the terminal cover 600 hook to the sides of the circuit breaker, hook to the underside of the circuit breaker, or be fastened by the same tab that holds the circuit breaker into the panel board. As another example, the steps of all processes and methods herein can be performed in any order, unless two or more steps are expressly stated as being performed in a particular order, or certain steps inherently require a particular order. Accordingly, departures may be made from such details without departing from the spirit or scope of the applicant's general inventive concept.

What is claimed is:

1. A circuit breaker terminal cover comprising:

a cover having first and second side walls, a vented surface extending between the first and second side walls, the first and second side walls extending to form a wire opening, and a barrier extending between the first and second side walls that separates the vented surface from the wire opening; and at least one attachment portion configured to hold the terminal cover in place and to removably engage at least one of an opening, a side, an edge, a protrusion, a fastener, a wire, and a handle.

2. The circuit breaker terminal cover of claim 1, wherein the attachment portion comprises an opening configured to fit around a protrusion of a circuit breaker.

3. The circuit breaker terminal cover of claim 1, wherein the attachment portion comprises a plurality of hooked members.

4. The circuit breaker terminal cover of claim 1, wherein the attachment portion comprises a plurality of projections configured to slideably engage an exterior surface of a wire such that it can slide along the wire a first direction but resists movement in a second direction.

5. The circuit breaker terminal cover of claim 1, wherein the attachment portion is configured to engage and be secured by a wire locking screw.

6. The circuit breaker terminal cover of claim 1, wherein the cover includes a flexible door configured to provide access through the cover.

7. The circuit breaker terminal cover of claim 1, wherein the attachment portion comprises a recess configured to receive a screw head.

8. The circuit breaker terminal cover of claim 1, wherein the attachment portion comprises a projection configured to engage a recess of a screw head.

9. The circuit breaker terminal cover of claim 1, wherein the attachment portion is formed by the first and second side walls of the cover, the first and second side walls being spaced apart such that friction against the side walls holds the terminal cover in place.

10. A method for using circuit breaker terminal covers, comprising:

providing one or more terminal covers according to any one of the foregoing claims attached to one or more circuit breakers;

removing at least one terminal cover from each of the one or more circuit breakers to be connected;

connecting at least one wire to a terminal connector of the circuit breaker; and attaching the terminal cover to the circuit breaker.

11. A strip of circuit breaker terminal covers comprising:

a plurality of terminal covers each comprising:

a cover having first and second side walls, a vented surface extending between the first and second side walls, the first and second side walls extending to form a wire opening, and a barrier extending between the first and second side walls that separates the vented surface from the wire opening; and at least one attachment portion configured to hold the terminal cover in place and to removably engage at least one of an opening, a side, an edge, a protrusion, a fastener, a wire, and a handle; and at least one frangible connection joining two adjacent terminal covers of the plurality of terminal covers.

12. The strip of circuit breaker terminal covers of claim 11, wherein the at least one frangible connection is formed between the first side wall of a first terminal cover and a second side wall of a second terminal cover.

13. The strip of circuit breaker terminal covers of claim 11, wherein the attachment portion comprises an opening configured to fit around a protrusion of a circuit breaker.

14. The strip of circuit breaker terminal covers of claim 11, wherein the attachment portion comprises a plurality of hooked members.

15. The strip of circuit breaker terminal covers of claim 11, wherein the attachment portion comprises a plurality of projections configured to slideably engage an exterior surface of a wire such that it can slide along the wire a first direction but resists movement in a second direction.

16. The strip of circuit breaker terminal covers of claim 11, wherein the attachment portion is configured to engage and be secured by a wire locking screw.

17. The strip of circuit breaker terminal covers of claim 11, wherein the cover includes a flexible door configured to provide access through the cover.

18. The strip of circuit breaker terminal covers of claim 11, wherein the attachment portion comprises a recess configured to receive a screw head.

19. The strip of circuit breaker terminal covers of claim 11, wherein the attachment portion comprises a projection configured to engage a recess of a screw head.

20. The strip of circuit breaker terminal covers of claim 11, wherein the attachment portion is formed by the first and second side walls of the cover, the first and second side walls being spaced apart such that friction against the side walls holds the terminal cover in place.

21. A method for using a strip of circuit breaker terminal covers, comprising:

providing a first strip of terminal covers each comprising:

a plurality of terminal covers comprising a cover having first and second side walls, a vented surface extending between the first and second side walls, the first and second side walls extending to form a wire opening, a barrier extending between the first and second side walls that separates the vented surface from the wire opening, and at least one attachment portion configured to hold the terminal cover in place and to removably engage at least one of an opening, a side, an edge, a protrusion, a fastener, a wire, and a handle; and at least one frangible connection joining two adjacent terminal covers of the plurality of terminal covers;

separating two adjacent terminal covers along the frangible connection to form a second strip of terminal covers that is shorter than the first strip of terminal covers; and attaching the second strip of terminal covers to a plurality of circuit breakers.

22. The circuit breaker terminal cover of claim 1, wherein the cover is integrally molded in one piece.

23. The circuit breaker terminal cover of claim 11, wherein the strip of covers is integrally molded in one piece.

24. A circuit breaker terminal cover comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the attachment portion comprises a plurality of projections configured to slideably engage an exterior surface of a wire such that it can slide along the wire a first direction but resists movement in a second direction.

25. A circuit breaker terminal cover comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the attachment portion is configured to engage and be secured by a wire locking screw.

26. A circuit breaker terminal cover comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the cover includes a flexible door configured to provide access through the cover.

27. A circuit breaker terminal cover comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the attachment portion comprises a projection configured to engage a recess of a screw head.

28. A strip of circuit breaker terminal covers comprising:

a plurality of terminal covers each comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the attachment portion comprises a plurality of projections configured to slideably engage an exterior surface of a wire such that it can slide along the wire a first direction but resists movement in a second direction; and at least one frangible connection joining two adjacent terminal covers of the plurality of terminal covers.

29. A strip of circuit breaker terminal covers comprising:

a plurality of terminal covers each comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the attachment portion is configured to engage and be secured by a wire locking screw; and at least one frangible connection joining two adjacent terminal covers of the plurality of terminal covers.

30. A strip of circuit breaker terminal covers comprising:

a plurality of terminal covers each comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the cover includes a flexible door configured to provide access through the cover; and at least one frangible connection joining two adjacent terminal covers of the plurality of terminal covers.

31. A strip of circuit breaker terminal covers comprising:

a plurality of terminal covers each comprising:

a cover having first and second side walls and a vented surface extending between the first and second side walls, the first and second side walls extending to form a wire opening; and at least one attachment portion configured to hold the terminal cover in place and to removably engage at least one of an opening, a side, an edge, a protrusion, a fastener, a wire, and a handle, wherein the attachment portion comprises a projection configured to engage a recess of a screw head; and at least one frangible connection joining two adjacent terminal covers of the plurality of terminal covers.

* * * * *